United States Patent [19]

Faigen et al.

[11] 4,087,823

[45] May 2, 1978

[54] BROADBAND DIPOLE ANTENNA SYSTEM HAVING THREE COLLINEAR RADIATORS

[75] Inventors: Ivan Faigen, Wayland; Ahmet Ergene, Boxboro, both of Mass.

[73] Assignee: Chu Associates, Inc., Littleton, Mass.

[21] Appl. No.: 668,475

[22] Filed: Mar. 19, 1976

[51] Int. Cl.[2] ..... H01Q 9/16; H01Q 9/20

[52] U.S. Cl. ..... 343/791; 343/801; 343/885

[58] Field of Search ..... 343/790, 791, 792, 827, 343/885, 787, 788, 801

[56] References Cited

U.S. PATENT DOCUMENTS

| | | | |
|---|---|---|---|
| 3,000,008 | 9/1961 | Pickles | 343/841 |
| 3,428,923 | 2/1969 | Webb | 343/885 |
| 3,680,146 | 7/1972 | Leitner | 343/885 |

*Primary Examiner*—Eli Lieberman

*Attorney, Agent, or Firm*—Rines and Rines, Shapiro and Shapiro

[57] ABSTRACT

This disclosure deals with a three-element unit array (or stacked groups of the same) that enables the use of very large length-to-diameter dipole elements to cover broad frequency bands, greater than 2:1 in frequency ratio, by novel feed structures exciting the element gaps.

10 Claims, 5 Drawing Figures

BROADBAND DIPOLE ANTENNA SYSTEM HAVING THREE COLLINEAR RADIATORS

Figure 1:
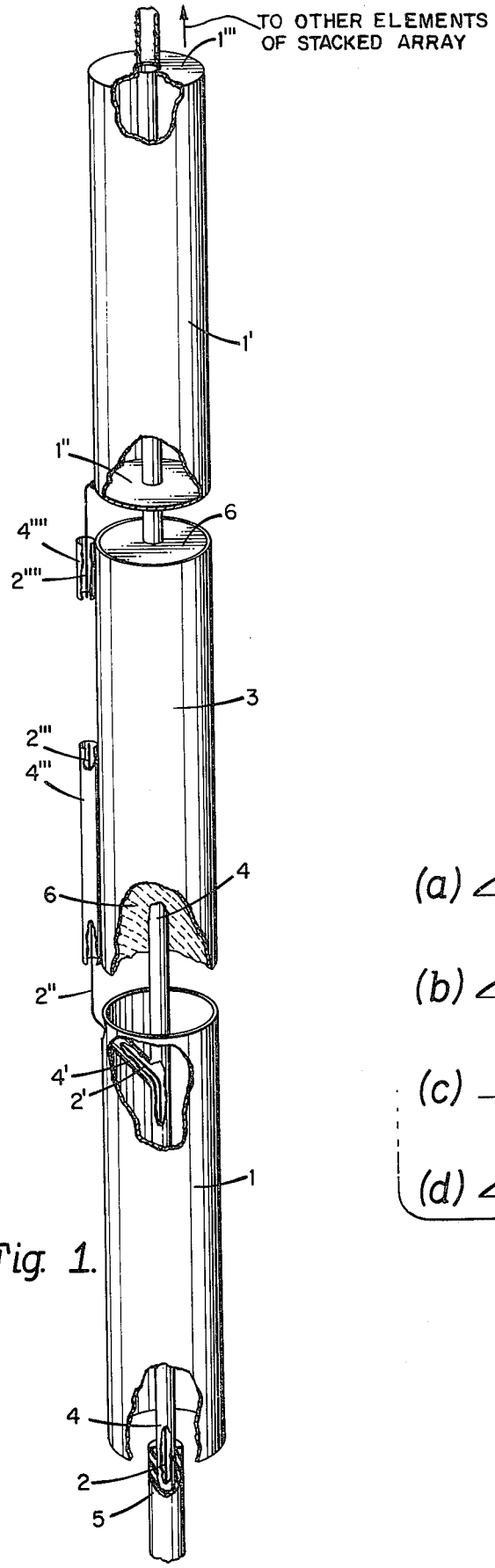
Figure 2:
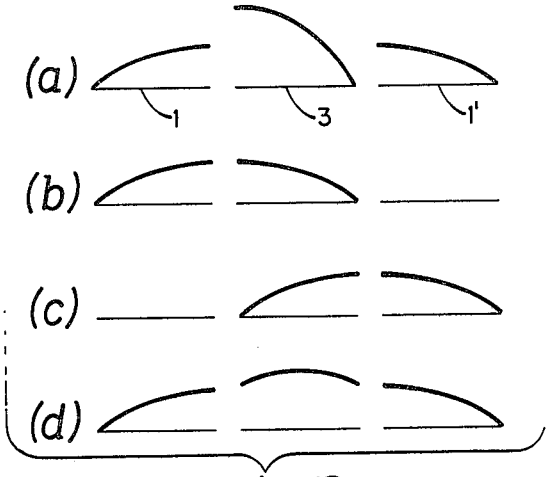

The present invention relates to dipole antenna systems, being more particularly directed to such antennas that are to be used to cover very wide bands of frequency with substantially uniform radiation coverage and with minimal dimensions and ready facility for connection in stacked arrays. In a preferred application, the invention is concerned with cylindrical dipole and monopole antennas covering wide bands of frequencies greater than two-to-one in frequency ratio, with efficient omnidirectional horizontal coverage, and with light weight construction permitting extremely high length-to-diameter ratios up to about 70-to-1, more or less, while maintaining a matched voltage standing wave ratio (VSWR) less than about 3.5:1.0 over the complete wide band of frequencies.

The problem of providing wideband dipole and monopole performance has previously been approached by enlarging the diameter or transverse cross-section of the dipole element, as by using wide rectangular or tapered planar sheets or large-diameter cones or cylinders. In the VHF bands, for example, multi-channel broadband communications over the 30 to 76 MHz band have been achieved by cylindrical cage dipoles four feet in outer diameter and 13 feet in length or height (U.S. Navy antenna AS-2231/SRA60V — Technical Manual 0967-177-3050, 421-4010), and by ground independent cylinders over a foot in diameter and almost 16 feet in length or height (cavity-balun fed cylinders of, for example, Radionics Incorporated, Webster, New York, Bulletin Models RAD 5632-62-82). Such antennas are vertically stacked and fed by interior coaxial lines, which can be of considerable length. To reduce wave distortion that could be caused by extraneous currents induced in the coaxial line outer conductors and the like, the array may incorporate the use of ground planes, sections of line chokes, or such devices as ferrite toroids (U.S. Pat. No. 3,680,146, for example) to assist in suppressing such extraneous currents and to enable independent frequency operation of successive dipole sections, if desired.

An object of the present invention is to provide a new and improved dipole and monopole construction and novel feed that enable the above-mentioned broadband response to be achieved, but with greatly reduced diameter or other cross-sectional dimension requirements, thus materially reducing the prior art size and cost limitations.

A further object is to provide a novel dipole and monopole element construction and feed of more general application, as well.

Still another object is to provide a simpler and more effective extraneous-current-suppressing feed for such dipole element arrays, particularly adapted for stacked configurations of the same.

Other and further objects will be explained hereinafter and are more particularly delineated in the appended claims.

In summary, from one of its broader aspects, the invention embraces a broadband antenna having, in combination, three successive in-line cylindrical antenna elements comprising first, center, and third elements, with gaps defined between the first and center, and center and third elements; and coaxial feed-line means disposed along the elements with the inner line thereof extending externally to the first element at and across the gap between the first and center elements, and the outer line thereof extending along the center element to form a transmission line section therewith and then connecting with the third element; the length of the in-line elements being large compared with the cross-section of the elements. Preferred constructional details and other features of the invention are hereinafter set forth.

The invention will now be described with reference to the accompanying drawing,

FIG. 1 of which is a side elevation of an antenna constructed in accordance with the invention in the illustrative configuration of a vertically oriented colinear array; and FIGS. 2(a) through 2(d) are current distribution diagrams illustrating the operation of the antenna.

Referring to FIG. 1, a vertically oriented dipole antenna system is shown comprising similar cylindrical lower and upper hollow dipole element sections 1 and 1′, with an intermediate cylindrical element section 3, successively disposed in-line. An axially mounted coaxial feed-line of inner conductor 2 and outer ground conductor 4 passes through the element 1 and branches off at 2′–4′ near the upper end of element 1, with the inner conductor extending outside the element 1 at 2″ to excite the gap between the upper end of element 1 and the lower end of element 3, terminating in an open-circuit coaxial stub feed section 2‴–4‴, the outer conductor 4‴ of which is soldered or otherwise connected to the cylinder 3. The outer conductor 4 of the line 2–4 continues axially within the cylinder 3 and through an insulating disc 6, and connects at a conductive lower end-plate 1″ to the lower end of the cylindrical element 1′, then extending to the insulating disc 1‴ at the upper end of the element 1′.

This configuration provides a uniquely symmetrical antenna with three sections permitting optimum feed-point impedances; the two end sections corresponding to the ground return arm of the dipole and the center or intermediate section corresponding to the other arm of the dipole. The term "ground" is used herein generally to embrace actual earthing or other reference potential. With each section made nominally one quarter of a wavelength long at the center of the wide frequency band, the current distribution shown in FIG. 2(a) would be expected, neglecting interelement capacitance and end fringing effects; that is, a typical dipole current distribution with the ground return current divided into two. To improve performance, while keeping the outside radiating surface of the center section 3 one-quarter wavelength long, the portion of the ground return current carried to the upper antenna element section 1′ by the effective line 4 - 3 can be made closer to a half-wavelength for proper phase relationships by the loading of the dielectric medium 6 between the transmission line elements 4 and 3.

The relatively short stub 2‴ – 4‴ serves as a capacitance linking the interface between the center section 3 and the adjacent antenna section, additional to the inherent capacitance present at this point due to the closeness of the sections. This construction has been found to modify the expected current distribution of FIG. 2(a) such that the current distribution over the center section 3 does not diminish to zero or a node as shown at the right-hand end of 3 in FIG. 2(a). To the contrary, the pairs of individual current distributions effected between elements 1 and 3, and 3 and 1′, take the form shown in FIGS. 2(b) and 2(c), respectively; resulting in the over-all current distribution of FIG. 2(c) that provides the novel broadband coverage performance of the invention with very small-diameter cylinders 1, 3 and 1' compared with the foot or several-foot diameters required of prior art fed dipoles for satisfactory broadband coverage over the same frequency band.

Thus, for the 30 – 76 MHz VHF band before mentioned, with the novel feed construction of FIG. 1, an 11 foot long antenna 1-3-1', only two inches in diameter (length-to-diameter ratio of 66:1) was successfully operated over said band with matched VSWR of less than 3.5-to-1.0 with substantially uniform omnidirectional horizontal coverage. At UHF (225–400MHz), the cylindrical element diameter was reduced to 1½ inches, with dielectric material 6 in the center antenna section 3 of up to about 10:1 dielectric constant-to-air ratio. Thus, arrays many feet long but only one or a few inches in diameter can now be used to achieve over 2:1 frequency band operation. Length to diameter ratios of from several tens-to-one up to 70:1 can be employed.

While not always needed, a coaxial matching stub 2'''' – 4'''', shorter than the feed stub 2'''–4''', has been found to help the broad-banding when connected as shown to the upper surface portion of the center antenna section 3, with the inner conductor bridging the gap between elements 3 and 1' and grounded to the lower end of the upper element section 1'.

The antenna configuration of the invention permits feedthrough of additional feed cables, as well, so that the basic array is appropriate for use in stacked, multichannel units and in multi-element colinear arrays without normally experienced deleterious fringing and coupling effects. The carrying of the long transmission line 2–4 along the stacked colinear elements, however, creates extraneous currents on the lines as before stated, which act to cause reductions in performance and other anomalies including radiation-pattern distortion, reduction in isolation between elements, reduction in antenna gains and match, or VSWR deterioration.

It is therefore often necessary to reduce or eliminate these extraneous line currents as by radio-wave traps or chokes, grounding schemes, and discrete ferrite or absorbing elements arranged either coaxially or toroidally along the transmission lines. The use of radio-wave traps or chokes, however, affects only narrow bands of frequency and is ineffective for broadband antennas or for multi-function antennas operating over widely separated bands of frequencies. The use of grounding techniques predicates large physical size and results in units that are heavy and cumbersome and in most cases, inappropriate, physically. The use of discrete ferrite or absorbing elements, although more effective, is cumbersome and costly and limits the number of lines that can be accommodated in a given antenna.

As a further feature particularly useful for the novel antenna of the present invention (though useful in other colinear and related arrays, also), it has been found that coating the transmission lines in the colinear array external to the elements, as at 5, with a continuous absorbing composition will act to reduce, eliminate, and absorb the transmission line currents in all broadbands of frequencies. The absorbent coating 5 may be brushed on, sprayed on, or molded. By using a continuous absorbing coating, rather than discrete ferrite elements or chokes, it has been found that distortions are more effectively reduced and performance enhanced compared to prior techniques.

The particular absorption coating preferably used consists of sintered ferrite powder of varying granular characteristic embedded in a dielectric casting medium such as epoxy, polyester, or other binders. The r-f absorbing compound can be adjusted in consistency and can be applied easily by brush, trowel, or injection.

In view of the flexibility of its current distribution and feed points, moreover, the antenna may be readily scaled for broadband operation in different wide bands of over 2:1 frequency range, much more so than simple dipoles, and with greater gain than a dipole at its upper operating frequencies (though somewhat narrower beamwidth thereat) due to the elongated electrical length.

Further modifications will also occur to those skilled in the art; such being considered to fall within the spirit and scope of the invention as defined in the appended claims.

What is claimed is:

1. A broadband antenna having, in combination, three successive in-line cylindrical antenna elements comprising first, center, and third elements, with gaps defined between the first and center, and center and third elements; and coaxial feed-line means disposed along the elements with the inner line thereof extending across the gap between the first and center elements, and the outer line thereof extending along the center element to form a transmission line section therewith and then connecting with the third element, said outer line being insulated from said center element for radio frequency energy in the operating frequency band; the length of the in-line elements being large compared with the cross-section of the elements.

2. An antenna as claimed in claim 1 and in which each element is adjusted to a length substantially one quarter the wavelength near the center of the frequency band.

3. An antenna as claimed in claim 2 and in which dielectric means is disposed between the center cylindrical element and the outer line extension therealong to provide a transmission line length closer to one-half said wavelength but an outer surface radiating length of said one quarter wavelength.

4. An antenna as claimed in claim 1 and in which a coaxial feed stub is provided near the end of the center element adjacent to the first element, with said inner line of the coaxial feed-line means being an extension of the inner conductor of said feed stub and insulated from said first and center elements for radio frequency energy in the operating frequency band.

5. An antenna as claimed in claim 4 and in which a coaxial matching stub is provided near the end of the center element adjacent the third element with an inner conductor extension thereof across the gap between the center and third elements terminating on the third element.

6. An antenna as claimed in claim 1 and in which said coaxial feed line is disposed axially within said elements.

7. An antenna as claimed in claim 6 and in which the connection of the center transmission line section to the third element is effected by an extension of the coaxial feed-line outer line through the third element with a conductive connection of the third element to the outer line at the end of the third element adjacent the center element.

8. An antenna as claimed in claim 1 and in which at least part of the outer line of the said coaxial feed-line means external to said elements is continuously coated with a dielectric layer containing ferrite particles to reduce extraneous line currents.

9. An antenna as claimed in claim 1 and in which the length-to-diameter ratio of the elements is from several tens-to-one to substantially 70-to-one.

10. An antenna as claimed in claim 1 and in which a plurality of sets of said three in-line elements are stacked to provide a vertical multi-channel system.

* * * * *